US012064704B2

(12) United States Patent
Sardo

(10) Patent No.: US 12,064,704 B2
(45) Date of Patent: Aug. 20, 2024

(54) MECHANICAL APPARATUS FOR CONTROLLING A PUPPET AND METHOD OF USING THE SAME

(71) Applicant: Jais Arthur Sardo, Cincinnati, OH (US)

(72) Inventor: Jais Arthur Sardo, Cincinnati, OH (US)

( * ) Notice: Subject to any disclaimer, the term of this patent is extended or adjusted under 35 U.S.C. 154(b) by 282 days.

(21) Appl. No.: 17/016,358

(22) Filed: Sep. 9, 2020

(65) Prior Publication Data

US 2021/0086090 A1 Mar. 25, 2021

Related U.S. Application Data

(60) Provisional application No. 62/903,875, filed on Sep. 22, 2019.

(51) Int. Cl.

| | |
|---|---|
| ***A63H 3/48*** | (2006.01) |
| ***A63H 3/40*** | (2006.01) |
| ***A63J 19/00*** | (2006.01) |

(52) U.S. Cl.

CPC ..... *A63H 3/48* (2013.01); *A63H 3/40* (2013.01); *A63J 19/006* (2013.01)

(58) Field of Classification Search

CPC ..... A63H 3/40; A63H 3/48; A63J 19/006

USPC ..... 446/337, 338, 339, 340, 341, 342

See application file for complete search history.

(56) References Cited

U.S. PATENT DOCUMENTS

| | | | | | |
|---|---|---|---|---|---|
| 2,207,190 | A * | 7/1940 | Carnahan | A63F 9/00 | 273/108 |
| 2,285,472 | A * | 6/1942 | Tenenbaum | A63H 3/48 | 446/378 |
| 2,705,850 | A * | 4/1955 | Evans | A63J 19/006 | 211/113 |
| 2,856,729 | A * | 10/1958 | Clintsman | A63J 19/006 | 446/341 |
| 3,070,920 | A * | 1/1963 | Bunin | A63J 19/006 | 352/54 |
| 3,193,969 | A * | 7/1965 | Rosenfeld | A63H 3/10 | 446/341 |
| 3,198,408 | A * | 8/1965 | Benner | A47F 7/065 | 446/268 |
| 3,747,261 | A * | 7/1973 | Salem | B23Q 1/545 | 446/124 |
| 3,964,205 | A * | 6/1976 | Kuramochi | A63H 3/18 | 446/338 |
| 4,094,092 | A * | 6/1978 | Bunin | A63H 3/14 | 446/341 |
| 4,196,541 | A * | 4/1980 | Clokey | A63H 3/04 | 446/374 |
| 4,421,485 | A * | 12/1983 | Geschwender | G09B 9/48 | 472/130 |

(Continued)

*Primary Examiner* — Joseph B Baldori

(74) *Attorney, Agent, or Firm* — Goldstein Law Offices, P.C.

(57) ABSTRACT

An apparatus for the use of controlling a puppet to obtain a desired position or display, with a mounting plate defining at least one aperture; at least one rod having a first and second end; a ball brace configured to engage a ball and the rod, engaging the rod between the first and second end; wherein the ball brace may be locked and unlocked; wherein the rod further comprises a coating on the second end to engage with the inside of a puppet; and wherein the rod, when engaged with the inside of the puppet, moves the inside of the puppet when moved.

11 Claims, 10 Drawing Sheets

(56) References Cited

U.S. PATENT DOCUMENTS 4,698,927 A * 10/1987 Yoshiro ..... A44C 3/001 446/337
4,798,556 A * 1/1989 Vicars ..... A63H 3/365 446/391
5,011,450 A * 4/1991 Chen ..... A63H 13/04 40/418
5,791,475 A * 8/1998 Pichardo ..... G09B 23/283 446/73
5,800,242 A * 9/1998 Clokey ..... A63H 3/04 446/337
5,862,615 A * 1/1999 O'Rourke ..... A44C 3/001 446/139
5,870,842 A * 2/1999 Ogden ..... G09F 19/08 446/362
5,921,839 A * 7/1999 Siren ..... B43M 99/003 40/411
6,110,001 A * 8/2000 Chae ..... A63H 3/31 446/183
6,733,359 B1 * 5/2004 Jacobs ..... A63H 13/005 446/391
6,758,717 B1 * 7/2004 Park ..... A63H 3/365 446/337
6,827,626 B1 * 12/2004 Feeney ..... A63H 3/16 446/361
6,905,390 B2 * 6/2005 Fukui ..... B25J 19/00 446/337
8,251,769 B2 * 8/2012 Cao ..... A63H 3/40 446/343
8,888,553 B2 * 11/2014 McMullen ..... A63H 3/365 446/321
8,998,672 B2 * 4/2015 Lin ..... A63H 3/20 446/337
9,592,455 B2 * 3/2017 Tiefel ..... A63H 3/20
10,621,896 B2 * 4/2020 Kasuga ..... A63H 3/36
10,981,075 B2 * 4/2021 Bellon ..... A63H 3/20
11,358,069 B2 * 6/2022 Lee ..... A63H 11/00
2005/0170746 A1 * 8/2005 Wee ..... A63H 30/02 446/331
2006/0094330 A1 * 5/2006 Privett ..... A63J 19/006 446/330
2007/0099537 A1 * 5/2007 Sandoval ..... A63H 5/00 446/331
2021/0308594 A1 * 10/2021 Lovik ..... A63H 3/40

* cited by examiner

MECHANICAL APPARATUS FOR CONTROLLING A PUPPET AND METHOD OF USING THE SAME

CROSS-REFERENCE TO RELATED APPLICATIONS

The present application claims the benefit of priority to U.S. Provisional Patent Application 62/903,875 filed Sep. 22, 2019, with first named inventor Jais Arthur Sardo.

TECHNICAL AREA

The present invention relates to mechanics for animating facial movements in a physical medium, namely puppets. More particularly, the invention relates to a mechanical apparatus that is capable of positioning the a surface of a puppet, for example, a face of a puppet in various combinations using a rod and ball system that is housed inside the puppet's head or cavity.

BACKGROUND

In the world of stop motion animation, there are many different techniques to achieve facial movement in puppets. The methods used can vary from simple, inexpensive and speedy to complicated, very expensive and extremely laborious. All methods have their own unique appeal in the stop motion animation community.

An example of one of the early techniques for facial movement in stop motion animation is molding facial positions on a clay faced puppet, as used in "claymation", to create desired expressions, speaking postures and the like. Because clay will hold its shape, the animator is able to take a still photograph of each desired movement to be played in succession and create the illusion of fluid movement. This technique is still used today because it is inexpensive, relatively fast and many people enjoy its authenticity. However, claymation has some disadvantages. Unwanted fingerprints and tool impressions are left behind on the puppet's face making it look messy and obscuring the desired facial expression. Also, the clay is less realistic in appearance and movement compared to newer methods.

More recently, the use of 3D printing has become a popular technique for "facial replacement" in stop motion animation. 3D printing technology has made it possible to make exact replicas of a character's face with thousands of different expressions, speaking postures and other nuances. A new face can be placed on a puppet for each position and photographed in sequence to achieve the desired illusion of movement. Facial replacement is used in most big studio stop motion animation films today. This technique is far more extravagant in cost and supply than claymation and is more time consuming. It can also come across as less organic. The desired presentation of the facial expression should be able to replicate the apparent "warmth" and tangible nature of previously described techniques, while allowing greater flexibility and adjustment. 3D printing may leave a face in the realm of the "uncanny valley," an unsettling aesthetic wherein the face is close enough for the viewer to recognize as human, but not close enough to be emotionally accepted.

Therefore, a need exists in the industry for a novel facial movement system for puppets that is expeditious and economical. There is also a need for the facial movement method to be life-like and naturalistic. A further need exists for the system to be reconfigurable to adapt to different sizes and shapes of puppets. Finally, there is a need for the facial movement system to be capable of holding each facial position in place to allow for the taking of still photographs.

SUMMARY

The present invention comprises a facial movement apparatus for puppets used in stop motion animation generally consisting of one or more moveable positioning rods with the rods able to moved via at least rotational, twist and slide movement. Positioning rods may be adhered to the interior surface of a puppet's face at designated action points. The rods may be configured to extend from the interior action points through predetermined apertures on a mounting plate which is positioned inside the puppet's head or cavity. The positioning rods may be joined on the back side of the mounting plate using balls with through holes (which may allow for rotational, twist and/or slide movement) and secured with ball braces. The positioning rods may be configured to extend further from the mounting plate to the rod ends. The rod ends are configured as the point where an operator may manipulate the rods for facial movement of the puppet. The operator may lock the positioning rods into place when a desired pose has been achieved by tightening the ball brace to the mounting plate with a threaded tension screw.

DETAILED DESCRIPTION

Figure 1:
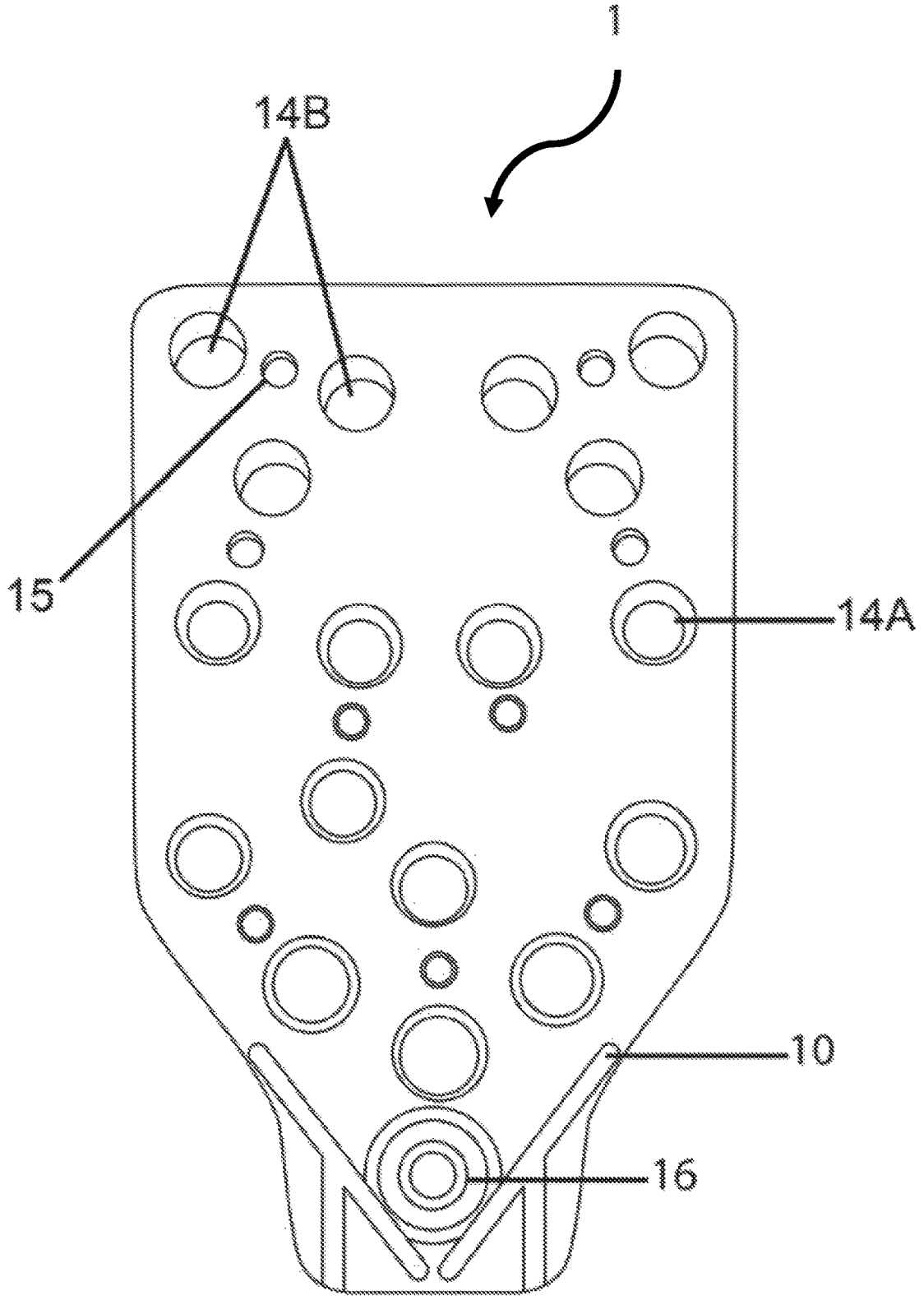
FIG. 1 is a rear side view of a mounting plate accord to an embodiment of this invention.

FIG. 1 depicts a mounting plate 10 for a movement apparatus 1 for puppets. The mounting plate 10 may be of a generic or custom origin. While the shape shown in FIG. 1 is shaped substantially as a pentagon with rounded edges, the mounting plate 10 may be designed to be different sizes and shapes, as necessary to perform and integrate with puppets or covers of varying qualities. In a preferred embodiment, example, the mounting plate 10 is 7.5 cm length and 5 cm width to fit inside the head cavity of a puppet with a head circumference of 24 cm and 8 cm from puppet maxilla to crown. The mounting plate 10 can be made from brass, hard plastic or other material of similar strength properties. While the movement apparatus 1 is shown with a puppet face, the apparatus 1 may be used a full puppet body, a respirating puppet stomach, articulated puppet arms, or for any type of physical structure wherein elements of the external body must be finely controlled, held in place, and able to be moved again.

The mounting plate 10 may be defined at least one rod aperture 14A and in preferred embodiments may define many rod apertures 14A as needed for desired facial movement and/or as many rod apertures 14A as there is space available on the mounting plate 10. In this example, eighteen rod apertures 14A have been defined and configured on the mounting plate 10 in customized locations for optimum movement on a specific puppet. Rod apertures 14A may be coupled to create aperture pairs 14B. The rod apertures 14A may be countersunk on the rear side of the mounting plate 10 to accommodate rotating balls. Additionally or alternatively, the mounting plate 10 may further define at least one threaded fastening aperture 15. In preferred embodiments the mounting plate 10 may be configured with one fastening aperture 15 centered between every pair of rod apertures 14B. While the rod apertures 14A are shown to be circular and of generally the same size, the rod apertures 14A may be any size and shape able to receive a positioning rod 3A as defined herein. Additionally or alternatively, the rod apertures 14A may vary amongst themselves instead of being of the same size and shape as one another.

The mounting plate 10 may be configured with one or more mounting elements to engage or affix to another element of the puppet. In this example, a mounting ball joint 16 comprises a male element that is suitable for insertion into the puppet body, which in the state of the art of stop motion animation generally comprises a ball and socket armature frame. The mounting joint 16 may be adaptable and customized to any puppet frame type. The mounting ball joint 16 may be made from metal, hard plastic or other material strong enough to engage with the puppet body and hold the mounting plate 10 in place during operation.

Figure 2:
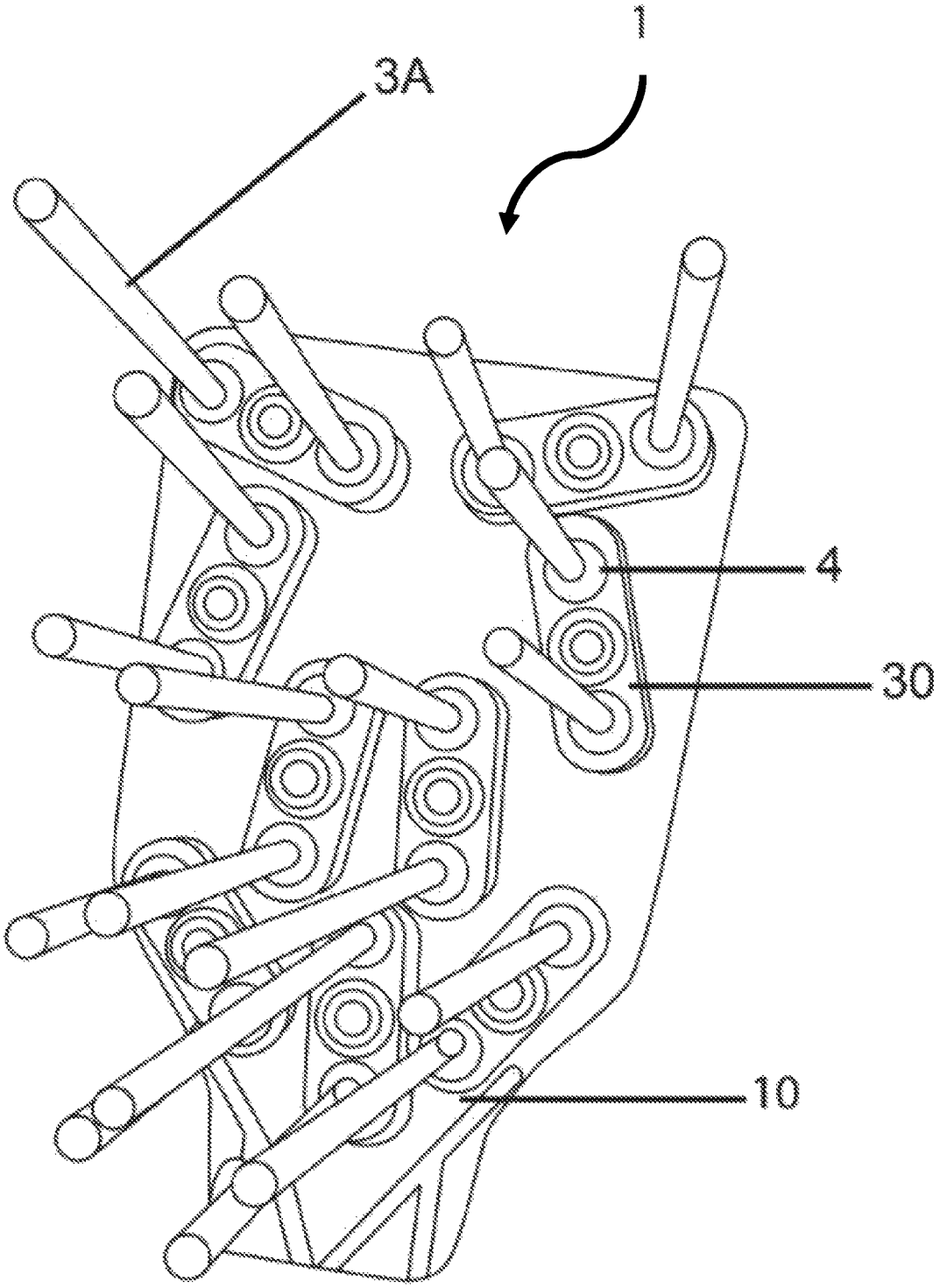
FIG. 2 is a perspective view of an embodiment of the invention described herein.

FIG. 2 depicts a rear perspective view of one example of a manual facial movement apparatus 1 for puppets according to various embodiments of the present invention. It is from the rear side of the apparatus 1 that an operator may manipulate the positioning rods 3A to affect movement on a puppet's face. The facial movement apparatus 1 may be configured with one or more positioning rods 3A that are used to manipulate one or more points of action on the puppet's face. Points of action may include, an eye, the corner of the mouth, an eyebrow, and/or any point for desired movement on a puppet face. The mounting plate 10 houses the positioning rods 3A, wherein the extension of the positioning rods 3A through the rod apertures 14A provides a fulcrum for the positioning rods 3A. In this example, the apparatus 1 comprises eighteen positioning rods 3A. The positioning rods 3A may be located on the mounting plate 10 in relation to the purpose of the rods function. For example, a positioning rod 3A in the upper left corner of the mounting plate 10 may be used to operate the left eyebrow on a puppet face. Alternatively, positioning rods 3A may be positioned across from the intended operation of the puppet face to allow more extreme control. Positioning rods 3A may be made from aluminum, wood, plastic or other lightweight material with similar strength properties. While the positioning rods 3A are shown to be relatively the same length, size, and cross-section, it is contemplated that the positioning rods 3A may be of any length, size, or cross-section and extrusion of the same to provide the benefit needed for facial control of a puppet. Additionally, positioning rods 3A may vary amongst themselves.

Positioning rods 3A may be joined to the mounting plate 10 with a ball 4 and ball brace 30. The balls 4 may have through holes to accommodate the positioning rods 3A. The through holes on the balls 4 may have a medium pressured fitted shaft to prevent free sliding. The medium pressure shaft in the balls 4 may also support and guide the positioning rods 3A in forward and reverse movement. The balls 4 may sit in countersunk rod apertures 14A on the rear side of the mounting plate 10. The countersunk rod aperture 14A may comprise an opening surface on the opposite/front side of the mounting plate 10 that is approximately 85% of the ball's 4 diameter, this may allow rotational and twist movement of the ball 4 and also prevent the ball 4 from forward movement. In this example, there are eighteen balls 4 to accommodate eighteen positioning rods 3A. Balls 4 may be made from hard plastic, metal, glass filled nylon or any other suitable material.

Figure 3:
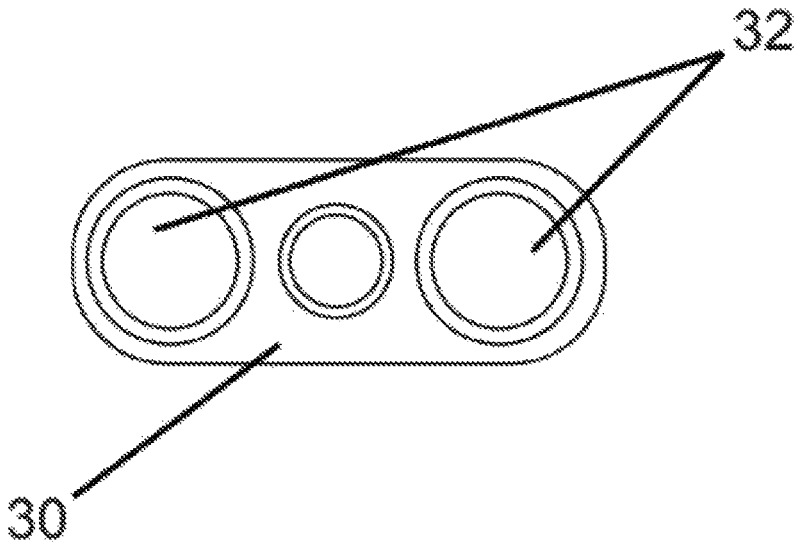
FIG. 3 is a front view of a ball brace according to various embodiments.

FIG. 3 shows a ball brace 30. The front of the ball brace 30 faces the balls 4 and the mounting plate 10. The ball brace 30 may define a plurality of apertures, in this case three. The front of a ball brace 30 may have two countersunk ball apertures 32 which may have an approximate 90% opening surface on the rear side of the ball brace 30, this may allow rotational and twist movement of the ball 4 and also prevent the ball 4 from backward movement in relation to the mounting plate 10. Some ball brace 30 embodiments may be configured to hold one or more balls 4 depending on the desired number of positioning rods 3A, the positioning rods location, and/or space available. The ball brace 30 can be made of metal, plastic or other suitable material. In an exemplary embodiment, the rods 3A extend through the ball brace 30 and through the ball 4 via the through hole.

Figure 4:
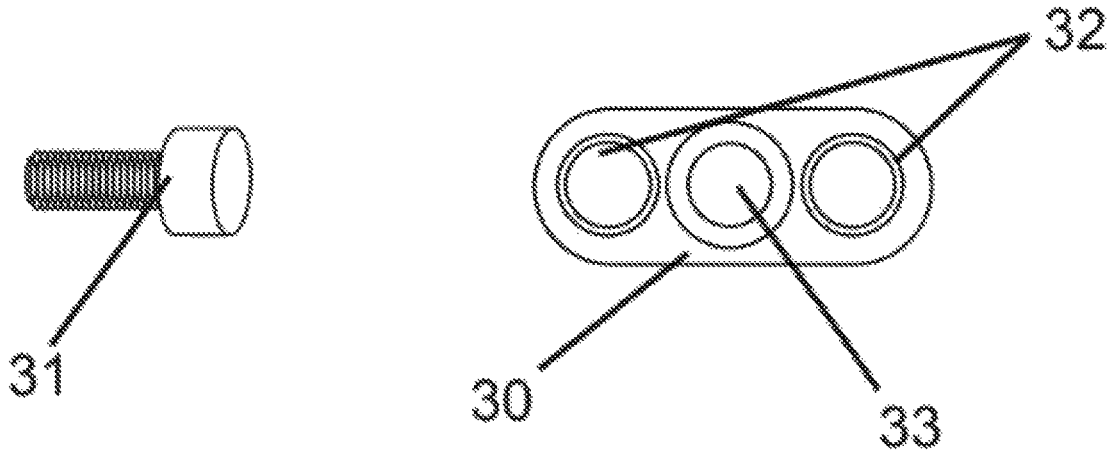
FIG. 4 is an exploded side view of a ball brace and tension screw according to various embodiments.

FIG. 4 depicts another embodiment of a ball brace 30 and a tension screw 31. The rear view of the ball brace 30 shows an example of a countersunk fastening aperture 33 that is centered between the two ball apertures 32. The fastening aperture 33 may be fitted for a threaded tension screw 31 that fastens the ball brace 30, and therefore the balls 4 that rest inside the ball brace 30, to the mounting plate 10 as shown in FIG. 2. The tension screw 31 can engage or disengage varying degrees of tension with a clockwise or counterclockwise twisting motion. In this example, an hex screw is used and can be engaged with an hex key tool. The tension screw 31 can be a bolt type, screw type or any other suitable threaded fastener. Additionally or alternatively, the ball brace 30 may be affixed to the mounting plate 10 by other means, such as a glue, epoxy, welding, or any other method capable of affixing the ball brace 30 to the mounting plate 10. While a ball brace 30 is shown to define two apertures 32 through which positioning rods 3A may fit, and therefore the ball brace 30 is substantially elliptical, the ball brace 30 may further define additional apertures 32 and have triangular, rectangular, or any other shape conducive to its purpose.

Figure 5:
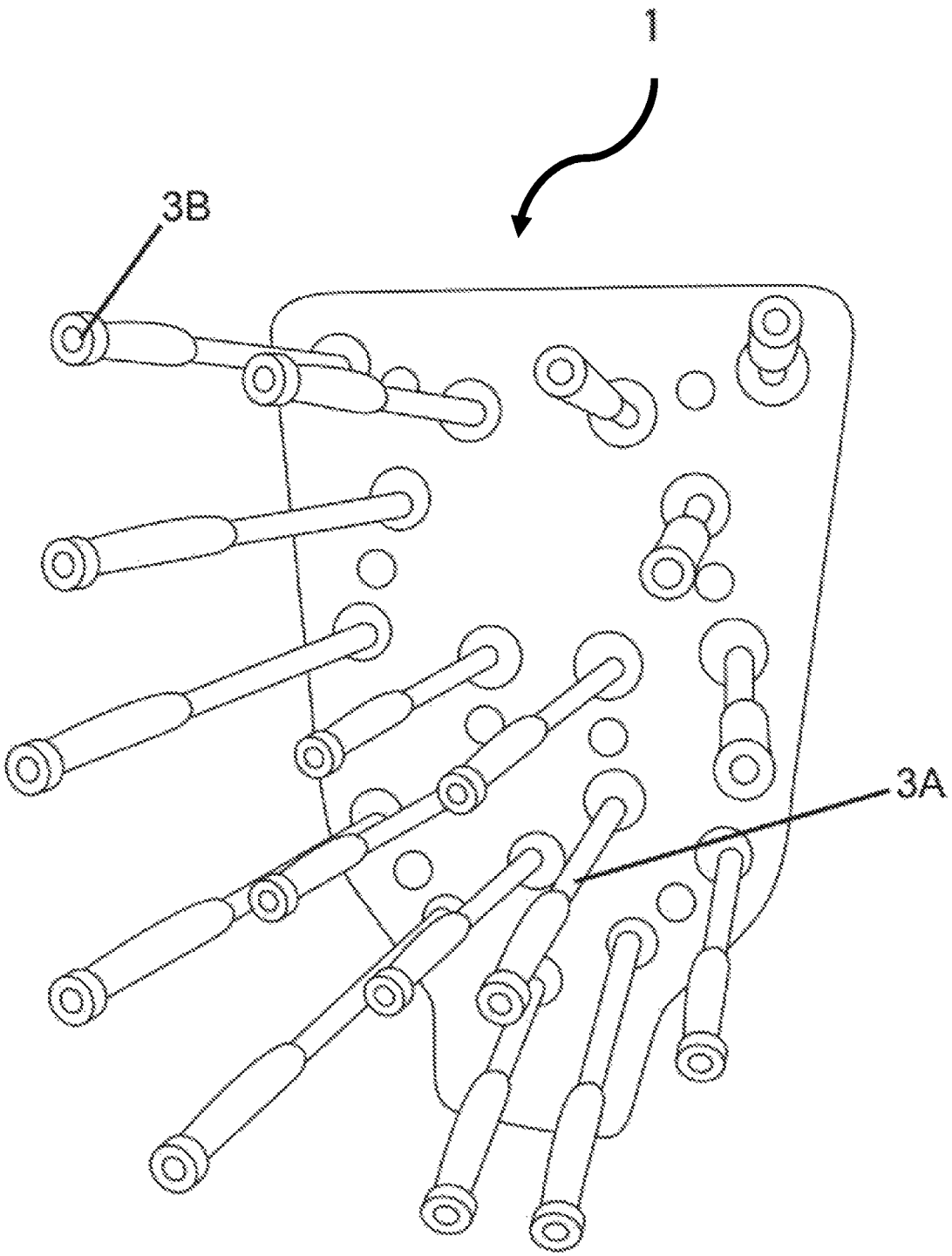
FIG. 5 is front perspective view of an embodiment of the invention described herein.

FIG. 5 illustrates a front perspective view of one example of a facial movement apparatus 1 for puppets according to the various embodiments of the present invention. This perspective of the apparatus 1 shows the rod heads 3B of the positioning rods 3A. Each rod head 3B may be adhered to a specific point of action on the interior surface of a puppet's face. In this example, there are eighteen positioning rods 3A that may correspond with eighteen action points on a puppet's face. In preferred embodiments the rod heads 3B are rounded and dipped in silicone or similar material to be less abrasive. While FIG. 5 shows an embodiment wherein all positioning rods 3A comprise rod heads 3B, it is contemplated that not all rods 3A necessarily comprise a rod head 3B. Further, as described above, the positioning rods 3A may have varying lengths and cross-sections. Additionally or alternatively, the rod heads 3B may match the length and/or cross-sections of the positioning rods 3A. Additionally, certain positioning rods 3A may have multiple rod heads 3B, thereby allowing the operator to manipulate multiple elements of the puppet face in a coupled fashion while only moving one positioning rod 3A.

Figure 6:
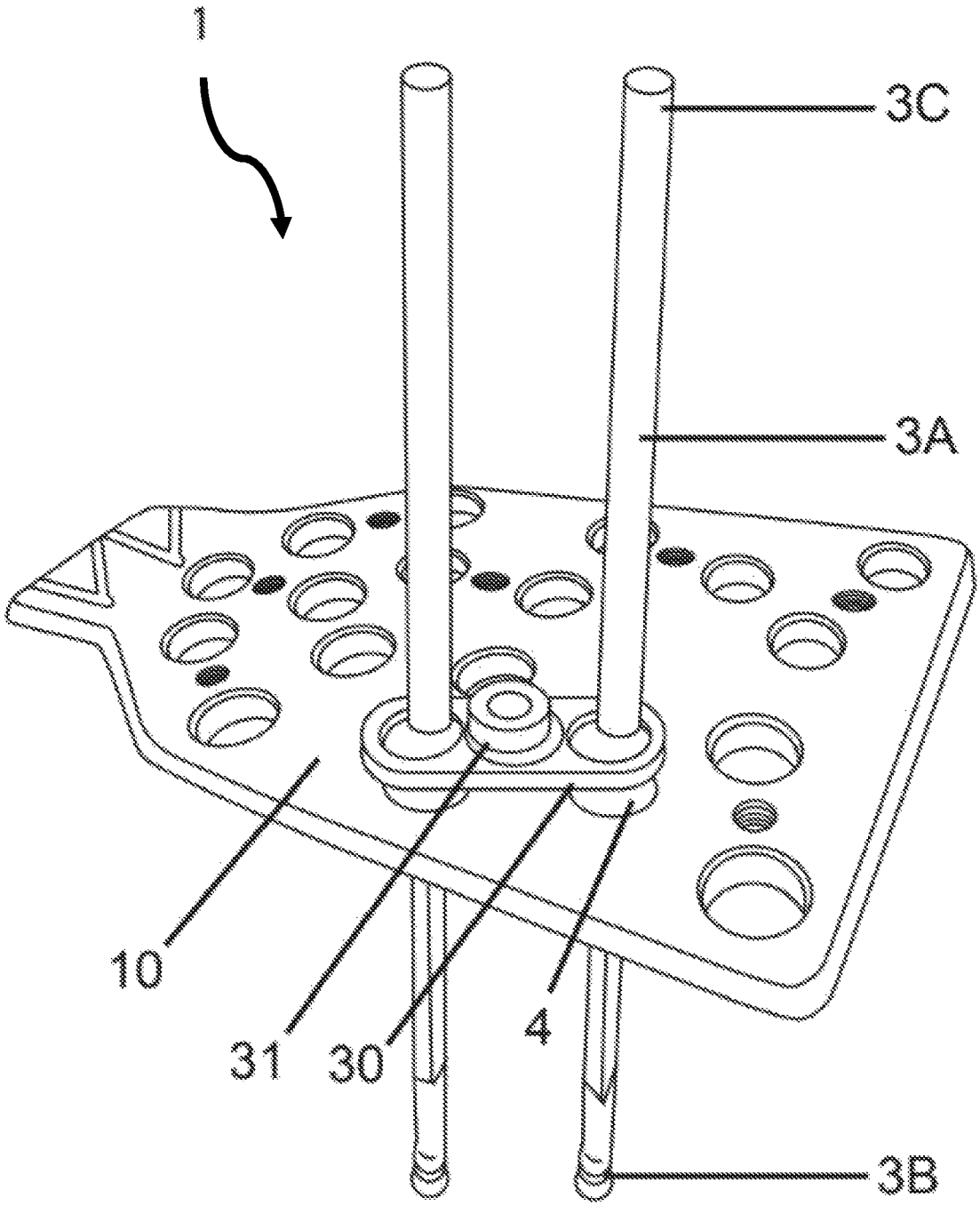
FIG. 6 is side perspective view of an embodiment of the invention described herein.

FIG. 6 depicts another embodiment of the apparatus 1 with positioning rods 3A engaged with the mounting plate 10 using a plurality of balls 4, a ball brace 30, and a tension screw 31. In this embodiment, the positioning rods 3A further comprise rod ends 3C. The positioning rods 3A may extend from the action points/rod heads 3B on the interior of a puppet's face through the rod apertures 14A on the mounting plate 10, through the balls 4 and ball braces 30 and further extend to the rod ends 3C. An operator may move the puppet's face by inputting force at the rod end 3C, with the movement then translating to the puppets face via positioning rod 3A and rod end 3B engaged with the puppet. The rotational direction of the force inputted at the rod end 3C will cause the positioning rod 3A to roll on the ball 4 as it passes through the axis point/mounting plate 10, and will force the rod head 3B to exert an output force opposite to that of the input force. For example, if the operator were to input a downward force at the rod end 3C, it would translate to an upward output at the rod head 3B and lift the action point on the puppets face upward. The rotational movement of the positioning rod is limited by the size of opening on either side of the ball 4 where the rod will come in contact with either the ball brace 30 (behind) or the mounting plate 10 (in front).

The positioning rods 3A may also be twisted or turned in a clockwise or counter clockwise direction from the rod end 3C. The positioning rod 3A will turn the ball 4 within the countersunk apertures and the rod will cause a twisting effect at the action point on the puppet's face.

The positioning rods 3A may also be moved in forward and reverse motion. An operator may input forward force at the rod end 3C to cause the positioning rod 3A to slide forward through the ball 4, the force exerted at the output/rod head 3B will push the action point forward on the puppet's face causing a protrusive effect. The same principle explains the reverse effect, only the operator may pull the positioning rod 3A backward, causing a recessed effect at the action point on the puppet's face. Forward movement may be limited by rod length and how far the material will stretch on the puppet's face. Reverse movement may be limited at the point where the puppet face and/or face elements back up far enough to meet the mounting plate 10.

Figure 7:
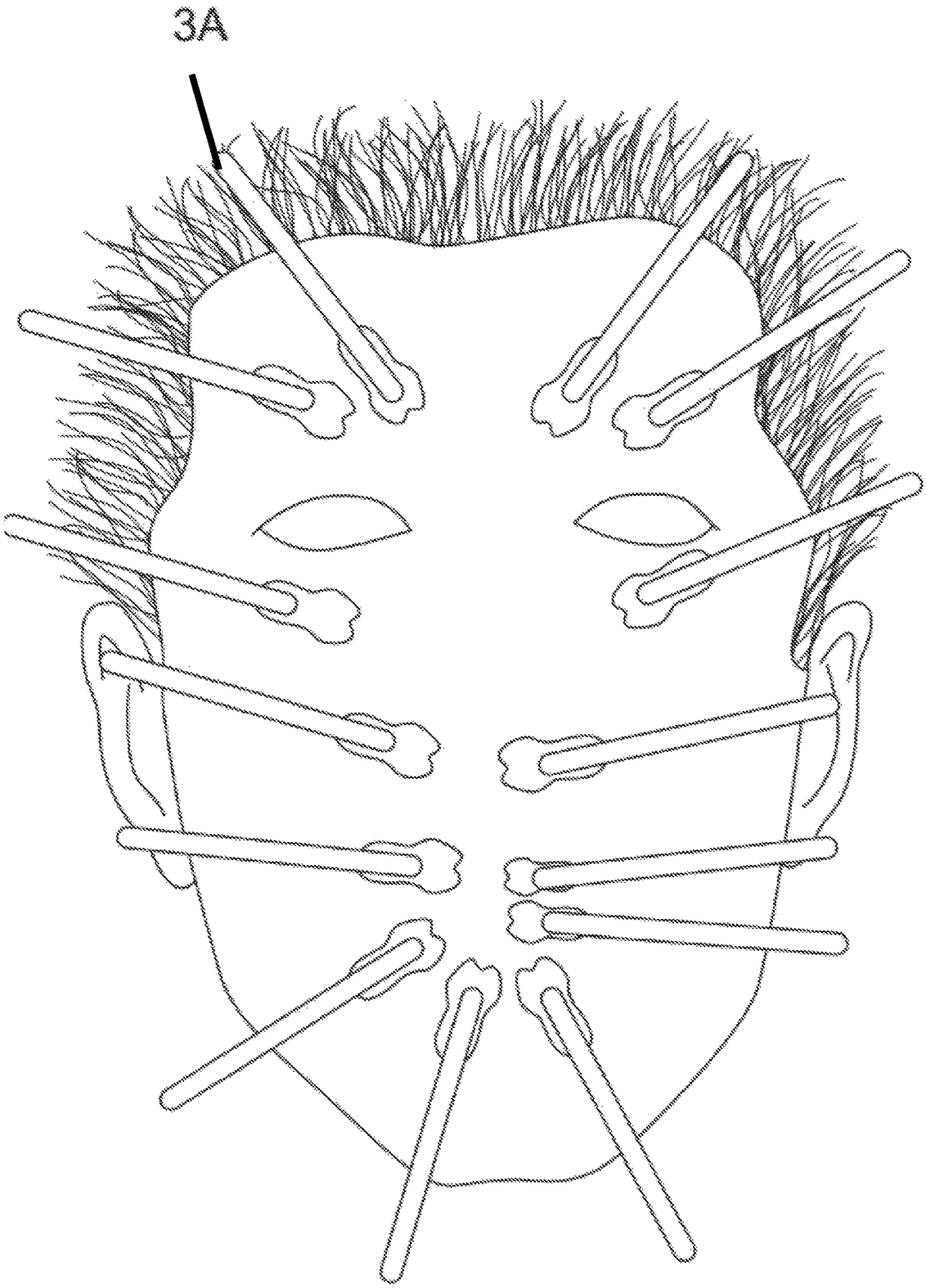
FIG. 7 is a cross sectional view of the rear of a puppet face.

FIG. 7 shows an example of an apparatus 1 with positioning rods 3A adhered to fourteen action points on the interior surface of a silicone puppet face. In preferred embodiments, rod heads 3B may be configured to be engaged in places where movement is the most active for naturalistic facial expressions, word postures and the like, such as along the eyebrows and mouth. Additionally or alternatively, the action points may be configured in any arrangement that is spatially achievable for desired movement. Positioning rods 3A may be adhered to a puppet with silicone, caulking, or other suitable flexible adhesive. While the puppet in FIG. 7 is substantially human, any puppet may be used where precise control of facial or other body part positions are desired.

Figure 8:
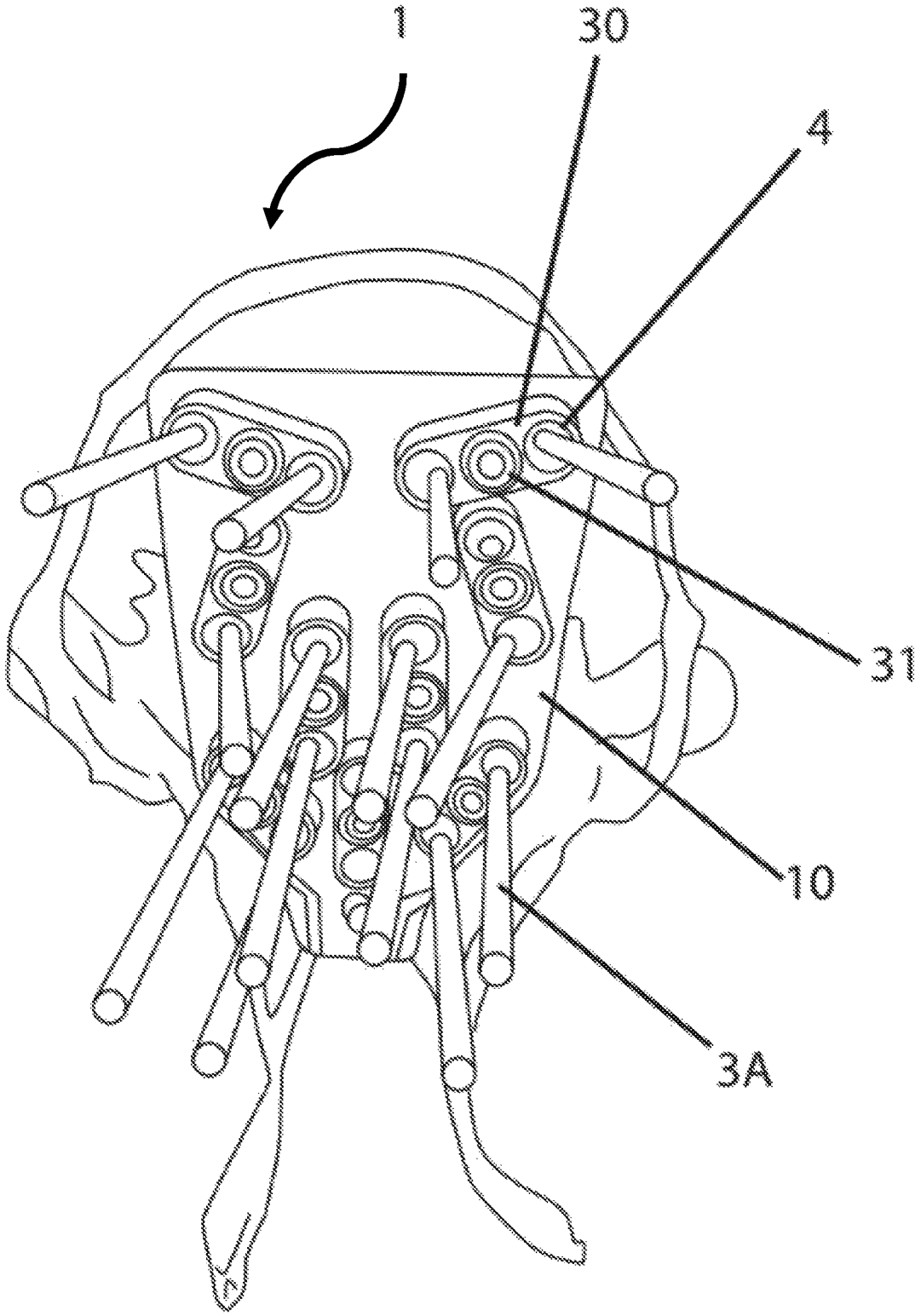
FIG. 8 is rear perspective view of an embodiment of the invention described herein.

FIG. 8 depicts a rear view perspective of an example of a facial movement apparatus 1 attached to a puppet face. In this example, the back half of the puppet's head is absent to allow for a clear view of the apparatus. In preferred embodiments, the mounting plate 10 may be positioned in the cavity of a puppet's head on a vertical axis, separating the front portion of the head from the back. It is from the back portion of the head that an operator may manipulate movement of the positioning rods 3A either directly or via ends 3C. For each movement, an operator may turn the tension screw 31 in a counter clockwise direction to loosen the ball brace 30 enough to move the positioning rods 3A to their desired position, when the desired position has been achieved the operator may turn the tension screw 31 clockwise to tighten the ball brace 30 and lock the balls 4 and rods 3A into stationary position. An operator may use his/her fingers, a gripping tool, or any other suitable method to move the positioning rods 3A.

In the exemplary embodiment shown in FIG. 8, with respect to the "face" of the puppet, there are eighteen rods 3A, with four rods 3A controlling eye brows, two rods 3A controlling the nose, two rods 3A controlling the eyes, four rods 3A controlling the mouth, four rods 3A controlling the cheeks, and two rods 3A controlling the teeth. For puppets of different shapes and sizes, or when desiring different levels of control for expression, the apparatus 1 may comprises any number of rods 3A necessary to control the elements of the puppet.

Figure 9:
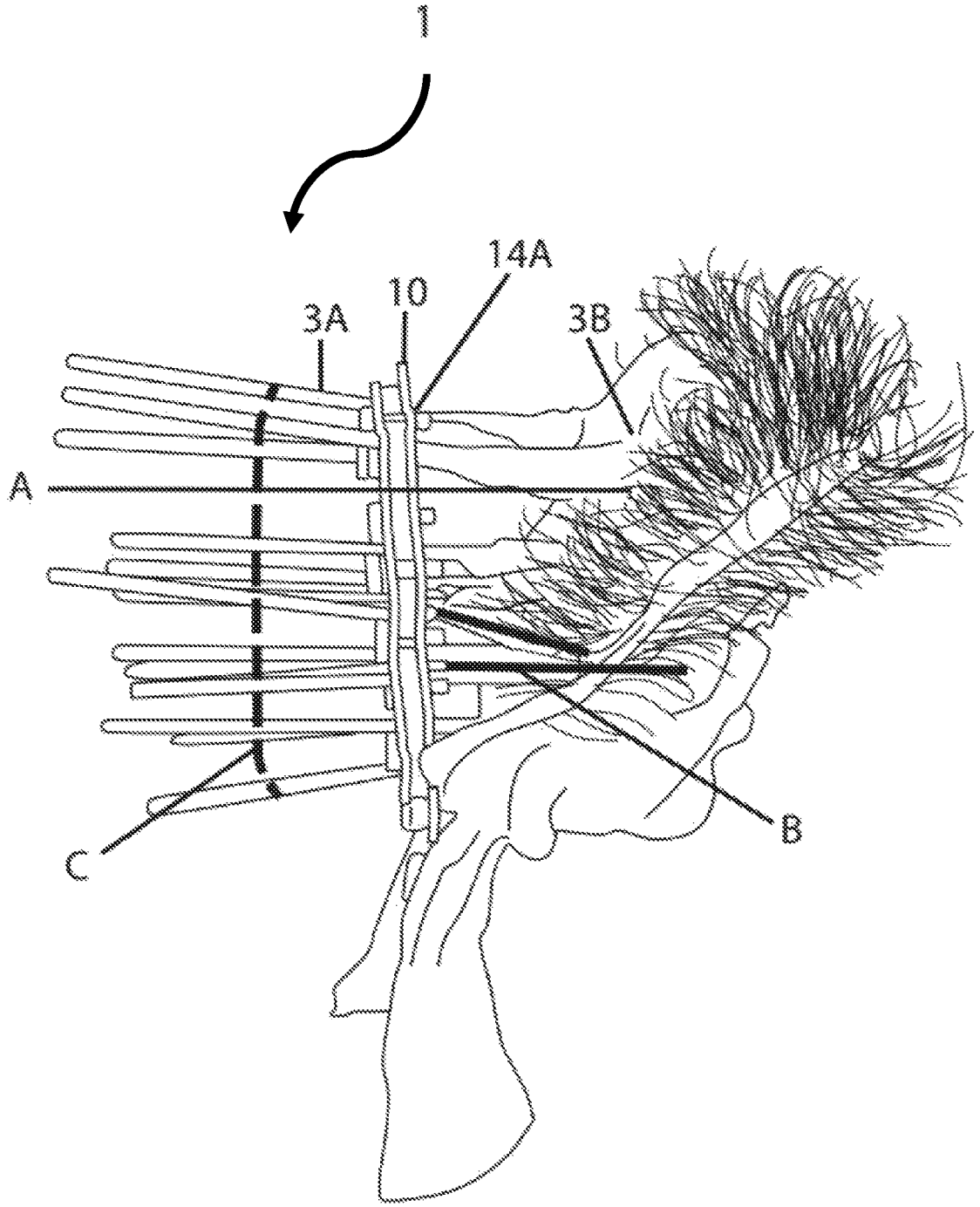
FIG. 9 is a side view of an embodiment of the invention described herein, further comprising a puppet face.

FIG. 9 shows a side perspective view of the facial movement apparatus attached to a puppet face with the puppet face partially separated from the apparatus 1. This perspective illustrates examples of variable neutral positions for positioning rods 3A. A positioning rod's 3A neutral position is determined by the location of the action point/rod head 3B to the location of the rod apertures 14A on the mounting plate 10. A rod aperture's 14A placement may be customized on a mounting plate 10 to achieve the greatest range of motion for a desired movement. For example, if the desired range of motion for the right eyebrow is to be greater in upward motion than downward motion, then the customized rod aperture 14A will be located on the mounting plate 10 in a higher position than the action point/eyebrow, creating a slope as shown in Example A. In preferred embodiments, some or all positioning rods 3A may be configured to a customized neutral position.

Figure 9B:
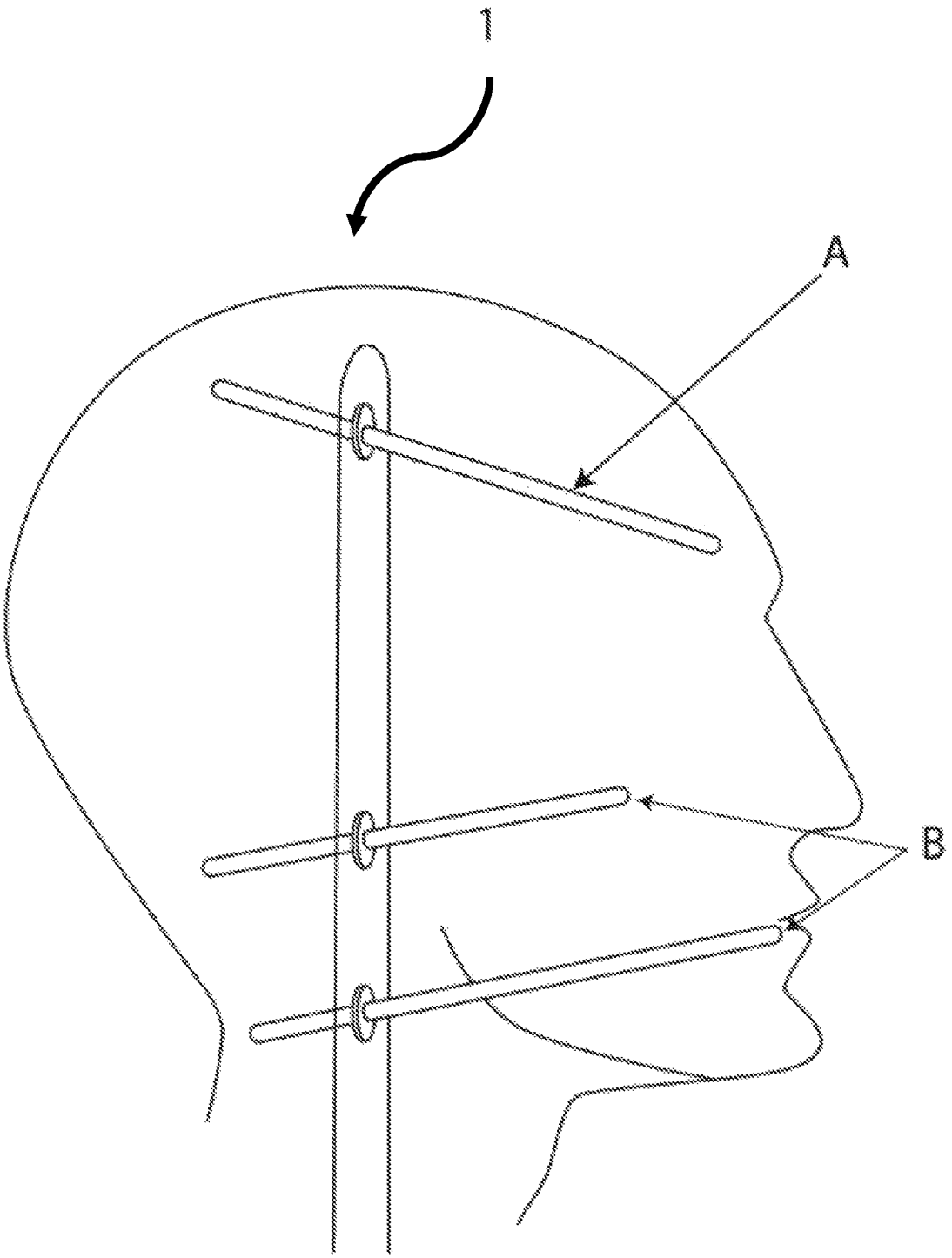
FIG. 9B is a side view of the mechanisms within the embodiment shown in FIG. 9, removing all but certain engaged rods for clarity.

Example B shows the variable distances from the action point/rod head 3B on the puppet's face to the mounting plate 10. The facial features of the puppet may be deeper or shallower in relation to the mounting plate 10 which may account for longer or shorter custom positioning rods 3A. In preferred embodiments, the positioning rods 3A may be custom sized to extend the length from the action point to the interior backside of a puppet's head. The dashed line in Example C references where the rods would end in such embodiments, this customization would make the rods capable of concealment inside the head. For the sake of clarity, FIG. 9B shows in block diagram the same with all but the particularly engaged rods 3A shown.

While preferred materials for elements have been described, the device is not limited by these materials. Wood, plastics, rubber, foam, metal alloys, aluminum, and other materials may comprise some or all of the elements of a facial movement apparatus.

Although the present invention has been illustrated and described herein with reference to preferred embodiments and specific examples thereof, it will be readily apparent to those of ordinary skill in the art that the other embodiments and examples may perform similar functions and/or achieve like results. All such equivalent embodiments and examples are within the spirit and scope of the present invention, are contemplated thereby, and are intended to be covered by the following claims.

The terminology used herein is for the purpose of describing particular embodiments only and is not intended to be limiting of the invention. As used herein, the term"and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Although a preferred embodiment of this invention has been disclosed, a worker of ordinary skill in this art would recognize that certain modifications would come within the scop-e of this invention. For that reason, the following claims should be studied to determine the true scope and content of this invention.

What is claimed is:

1. A method for controlling a puppet having an inside and having a nose, a mouth, eyes, eye brows, and cheeks, comprising:

providing at least eighteen rods, each rod having a first end and a second end, the at least eighteen rods including four rods engaging the eye brows, two rods engaging the nose, two rods engaging the eyes, four rods engaging the mouth, four rods engaging the cheeks, and two rods engaging the teeth;

providing a mounting plate defining apertures through which rods may extend, twist, and rotate, with the first end of the rods engaged with the inside of the puppet;

keeping the rods in place via a rod and ball system;

controlling each rod rods via its a second end to translate into movement on the first end and therefore the puppet; and locking the rods in place via a ball or pressure brace.

2. The method of claim 1, further comprising designating a certain combination of extensions, twists, retracting, extending, and rotations of the rods to define a desired facial positioning of the puppet.

3. The method of claim 2, further comprising locking the rods in combination in a first configuration.

4. The method of claim 3, further comprising a designation of a second configuration representing a second facial positioning.

5. The method of claim 2, wherein controlling the rods is done via an attached processing unit and controller.

6. The method of claim 1, further comprising adjusting, moving, and altering the extension and angles of certain rods to selectively rotate, twist, retract, and extend in combination.

7. The method of claim 6, further comprising a step of moving the rods from the first configuration to the second configuration to represent a certain facial action.

8. The method of claim 1, wherein the rod extends through the ball via a through hole in the ball.

9. The method of claim 8, wherein the rod further comprises a coating on the first end to engage with the inside of the puppet; and wherein the rod, when engaged with the inside of the puppet, moves the inside of the puppet when moved.

10. The method of claim 1, wherein the ball braces are adapted to lock and unlock independently of one another.

11. The method of claim 1, wherein each of the ball braces lock each of the rods in place, so that they cannot rotate within the apertures of the mounting plate.

* * * * *